United States Patent [19]

Waugh

[11] 4,111,011

[45] Sep. 5, 1978

[54] ADDITIVE DISPENSING SYSTEM

[75] Inventor: Richard A. Waugh, Louisville, Ky.

[73] Assignee: General Electric Company, Louisville, Ky.

[21] Appl. No.: 829,687

[22] Filed: Sep. 1, 1977

[51] Int. Cl.[2] ..... D06F 39/02

[52] U.S. Cl. ..... 68/17 R; 68/207; 137/874

[58] Field of Search ..... 68/17 R, 207; 137/873, 137/874, 875; 134/93, 100, 101, 172, 174

[56] References Cited

U.S. PATENT DOCUMENTS

| | | | |
|---|---|---|---|
| 2,988,908 | 6/1961 | Gerhardt | 134/93 X |
| 3,089,515 | 5/1963 | Bochan | 137/874 |
| 3,144,031 | 8/1964 | Long | 134/93 |
| 3,727,434 | 4/1973 | Bochan | 68/17 R |
| 3,945,388 | 3/1976 | Clark | 134/101 X |

FOREIGN PATENT DOCUMENTS

| | | | |
|---|---|---|---|
| 472,209 | 6/1969 | Switzerland | 134/93 |

*Primary Examiner*—Philip R. Coe

*Attorney, Agent, or Firm*—Frederick P. Weidner; Francis H. Boos

[57] ABSTRACT

An improved additive dispensing system for sequentially dispensing a plurality of treating agents into the wash tub of an automatic fabric washing machine at predetermined times during the washing cycle. A plurality of compartments are provided for retaining the various laundry additives to be dispensed into the wash tub. A liquid flow diversion arrangement having a diverter for selectively diverting liquid into pre-selected dispenser compartments is provided and includes a pivotal body with a liquid inlet at one end connected to a water inlet and a nozzle at the other end in liquid flow communication with the dispenser. A three position nozzle control mechanism includes two solenoids with plungers, a lever arm connecting the solenoid plungers, a biasing spring to center the lever arm when both solenoids are de-energized, and a rod connecting the lever arm and the nozzle whereby the nozzle is pivoted to a different position responsive to separate energization of each solenoid and de-energization of both solenoids.

5 Claims, 4 Drawing Figures

ADDITIVE DISPENSING SYSTEM

BACKGROUND OF THE INVENTION

1. Field of the Invention:

This invention relates to laundry machines, and more particularly to a mechanism in the laundry machine to improve the dispensing of laundry additives.

2. Description of the Prior Art:

Recent automatic clothes washing machines customarily proceed through a sequence of operation in order to wash, rinse and spin dry clothes. The sequence ordinarily includes a presoak, a first liquid extraction operation, a wash operation, a second liquid extraction operation, a rinse operation, and a final extraction operation.

In order to obtain the most desirable results from these machines, it has been found advantageous to introduce certain additives into the water or liquid used for a particular operation. A pre-wash additive is normally used in the soak operation, a soap or detergent is normally used in the washing operation and a bleach is often also used in this operation, while rinse agents are added to the rinse water.

In an automatic washing machine, it is desirable that these additives be dispensed automatically. When the dispensing of additives is automatic, the user may load the fabrics to be washed into the wash tub and place the additives into their proper compartments or containers, and the machine automatically completes the cycle of operations. Also, the best results are obtained if these various additives are dispensed with liquid so that additives are metered into the wash tub and evenly distributed rather than being concentrated into a few of the articles.

One such dispensing system for an automatic washing machine is disclosed in U.S. Pat. No. 3,727,434 assigned to the same assignee as the present invention. As disclosed in that patent the dispenser is normally latched to the access cover of the laundry machine for movement with the cover to an open position for access to the wash tub for loading fabrics therein, and unlatched for movement independent of the cover to a position over the tub for introducing treating agents into the dispenser.

The dispenser includes a plurality of compartments for storing treating agents to be dispensed selectively during the prewash, wash and rinse operations and a plurality of liquid inlets arranged to communicate with the compartments. In its operative effective position over the tube the liquid inlets are in a position to cooperate with the outlets of a liquid supply device. The liquid supply device is sequentially controlled to selectively direct recirculation liquid into preselected ones of the liquid inlet for mixing liquid with the treating agents being held in the compartments to flush the agents into the wash tub at predetermined times in a cycle of the automatic washing machine. As shown and described in U.S. Pat. No. 3,727,434, one type of liquid supply device is a fluid amplifier. Direction of the water flow path from the fluid amplifier can be detrimentally affected by a buildup of foreign matter on the fluid amplifier and the difference in flow rate of the water being directed by the fluid amplifier. Also, one of the difficulties with this type of arrangement is that the dispensing system utilizes recirculation water from the tub as the means for flushing the agents into the wash tub. Recirculation water, that which has been used previously in the soak operation contains lint or other relatively large contaminants which can affect the direction of the water flow path.

By my invention I have improved the additive dispensing system in that I have provided means for positively directing the flow of water into the dispenser for three different positions.

SUMMARY OF THE INVENTION

There is provided a treating agent dispenser system for an automatic washing machine having a basket, an outer tub and an additive dispenser adapted to be mounted above the machine's wash tub. This dispenser has a plurality of compartments for holding treating agents to be dispensed selectively into the wash tub at predetermined times during a cycle of the washer. This invention relates to an improved liquid flow diversion arrangement including a pivotal body with a liquid inlet opening at one end connected to a water inlet means and a nozzle at the other end with a liquid outlet opening in liquid flow communication with the dispenser. There is provided a three position nozzle control mechanism including two solenoids with plungers, a lever arm connecting the solenoid plungers, biasing means to center the lever arm when both solenoids are de-energized, and a rod connecting the lever arm and the nozzle whereby the nozzle is pivoted to a different position responsive to separate energization of each solenoid and de-energization of both solenoids.

DESCRIPTION OF THE PREFERRED EMBODIMENT

Figure 1:
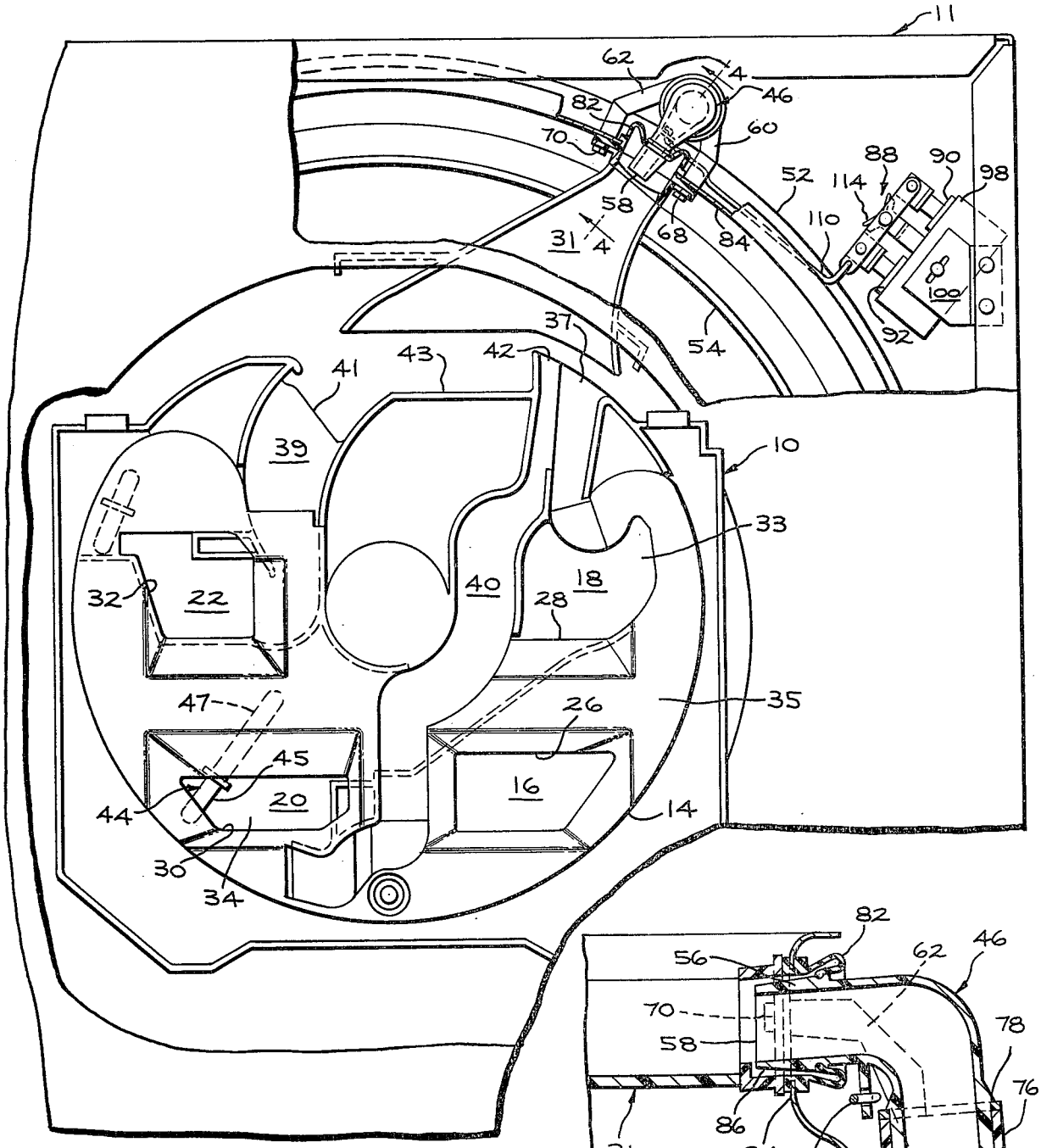
FIG. 1 is a plan view of the dispensing system with parts broken away and showing the present invention of an improved three position liquid diverter in the first position.
Figure 4:
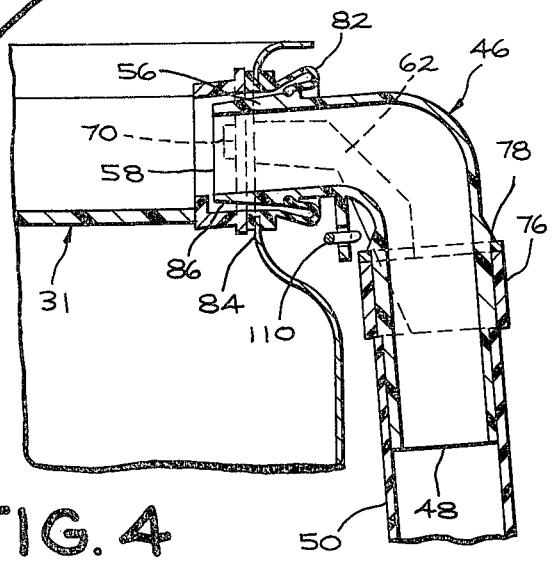
FIG. 4 is a side elevational cross-section view of the improved liquid diverter taken along lines 4—4 of FIG. 1.

Referring to FIG. 1, the dispenser 10 for an automatic clothes washer having a cabinet 11 is shown with the cover (not shown) removed therefrom to expose the details of construction of the present embodiment. The dispenser 10, as shown, is generally an annularly-shaped segmented channel or trough defined by annular outer wall 14. The dispenser 10 is divided into four annular compartments 16, 18, 20, and 22. The presoak agent is placed in compartment 18 through opening 28, detergent is placed in compartment 16 through opening 26, bleach is placed into compartment 20 through opening 30, and rinse agent is placed in compartment 22 through opening 32.

Unlike compartments 16, 20 and 22, compartment 18 is not designed to store a treating agent but merely provides a passageway for introducing prewash treating agents directly into the washing machine tub or into a filter pan (not shown) located between the tub and dispenser 10 to be effective during the first liquid fill cycle of the machine. To this end the bottom wall portion of the compartment 18 has a large opening 33 to facilitate easy dispensing of the prewash agent.

Liquid being pumped from the wash tub is introduced into the dispenser 10 by a liquid flow diversion assembly 31. The liquid for compartment 16 flows through channel 35 from inlet 37 to the compartment. Liquid for compartment 22 flows through channel 39 from inlet 41 to the compartment. Liquid for compartment 20 flows through channel 40 from inlet 42 to the compartment. When recirculation liquid is not required for flushing a laundry additive from the dispenser 10 the liquid from the liquid flow diversion assembly 31 is directed toward wall 43 but below it so that the liquid flows not into the dispenser 10 but into a filter pan below the dispenser 10. The wall 43 is therefore above the inlets 37, 41 and 42.

The liquid flow diverter assembly 31 includes a diverter mechanism, which will be described in detail later, and is sequentially controlled to selectively direct recirculation liquid into preselected inlets 37, 41 and 42 for mixing liquid with the treating agents being held in the compartments to flush the agents into the wash tub at predetermined times in a cycle of the automatic washing machine.

Detergent or soap to be dispensed from compartment 16 during the wash cycle is usually in solid, granular or high viscosity water soluble form. The bottom of the compartment 16 is provided with a discharge outlet at one end thereof (not shown) for flushing the detergent or soap to be dispensed into the wash load.

Bleach stored in compartment 20 is dispensed during the wash cycle subsequent to the dispensing of the detergent. At the proper time in the washing operation the machine timer controls introduction of recirculation water into liquid inlet area 42 for flow through channel 40 and into the bleach compartment 20.

Provision is made to drain the compartment 20 when there has been a sufficient amount of recirculation water introduced into the compartment to dilute the concentrated bleach prior to introduction of a diluted bleach solution into the wash load. One embodiment is shown and consists of a siphon tube 44. The siphon operates in a normal fashion wherein it has a short leg 15 positioned within the chamber 20 and spaced above the bottom wall 34 thereof. The other leg of the siphon extends through the bottom of the wall 34 and in communication with the interior of the wash tub for dispensing the diluted bleach solution into the wash.

When the diluted bleach solution reaches the top of the siphon the siphoning action starts with the diluted bleach solution being drained slowly through the siphon and into the wash load. It will be understood that this action of draining through the siphon will continue until the water entering the compartment 20 terminates and then the mixture of bleach and water in the compartment will continue to flow out through the siphon until the compartment 20 is emptied.

The improved liquid diverter mechanism will now be described. There is an L-shaped pivotal body 46 having a liquid inlet opening 48 at one end of body 46 which is connected to a water inlet means such as recirculation hose 50 wherein water is pumped from the tub 52 back into the basket 54 during the washing operation for lint filtering of the wash water. Such a system is not part of the present invention but is fully disclosed and described in U.S. Pat. No. 3,197,981 assigned to the same assignee as the present invention. At the opposite end of the body 46 is a nozzle 56 having a liquid outlet opening 58 in liquid flow communication with the dispenser 10 via the liquid flow diversion assembly 31.

The body 46 is secured in its proper position by support arms 60 and 62 which are at one end 64 and 66, respectively, secured to the tub 52 by screw fasteners 68 and 70. The other ends 72 and 74, respectively, of the support arms 60 and 62 respectively are secured to or integrally molded with a cylindrical member 76 through which the L-shaped body 46 passes. The body 46 is supported on the cylindrical member 76 by a pivot support shoulder 78 carried by the body 46. The body 46 and the cylindrical member 76 of the support cooperate so that the body 46 is pivotable within the cylindrical member 76. The nozzle 56 of body 46 protrudes from outside the tub 54 through an opening 80 into the interior of the tub 52. The tub opening 80 is large enough to allow the nozzle to be pivoted sufficiently to direct water into the liquid flow diversion assembly 31 in three separate flow paths. The tub opening 80 is sealed by a flexible diaphragm 82 secured to the inside surface 84 of tub 52 and the outside surface 86 of nozzle 56 by any suitable means. Conveniently, the flexible diaphragm 82 will also be used for sealing the screw fastening holes through the tub for holding the support arms 60 and 62. In this manner then the nozzle 56 can be moved or pivoted to several positions yet the liquid inside the tub cannot escape through the tub opening 80.

To position the nozzle 56 in the correct three positions for either flushing the additive compartments in their proper sequence or for directing liquid directly into the tub 52 through an underlying filter pan, there is provided a three position nozzle control mechanism 88 which includes two solenoids 90 and 92 each having plungers 94 and 96, respectively. The solenoids 90 and 92 are retained in a casing 98 which is secured in a fixed position to a bracket 100.

The plungers 94 and 96 of solenoids 90 and 92 are connected by a lever arm 102 as by pivot pins 104 and 106, respectively. At one end 108 of lever arm 102 a rod 110 is pivotably connected with the opposite end 112 of rod 110 connected to the nozzle 56. Such an arrangement then provides a push-pull operation of the nozzle 56 in response to movement of end 108 of the lever arm 102. Between the pivot pins 104 and 106 securing lever arm 102 to plungers 94 and 96, there is a centering lever biasing means 114 which will center the lever arm 102 when both solenoids 90 and 92 are de-energized. That centering position of the lever arm 102 is shown in FIG. 1.

Figure 2:
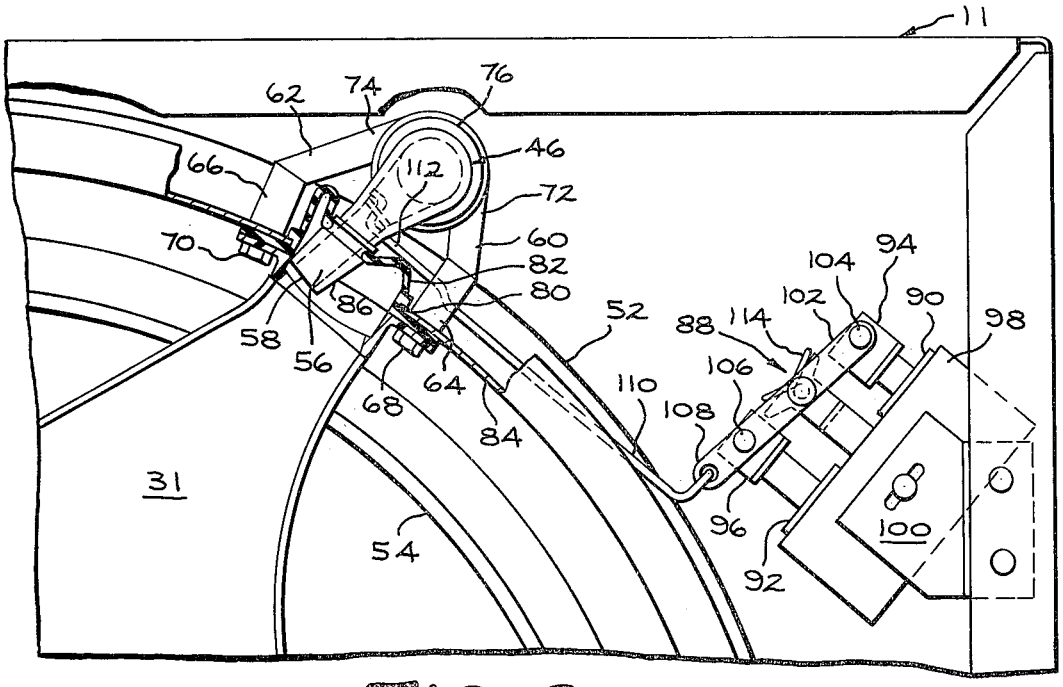
FIG. 2 is a fragmentary enlarged sectional view of the improved liquid diverter in the second position.
Figure 3:
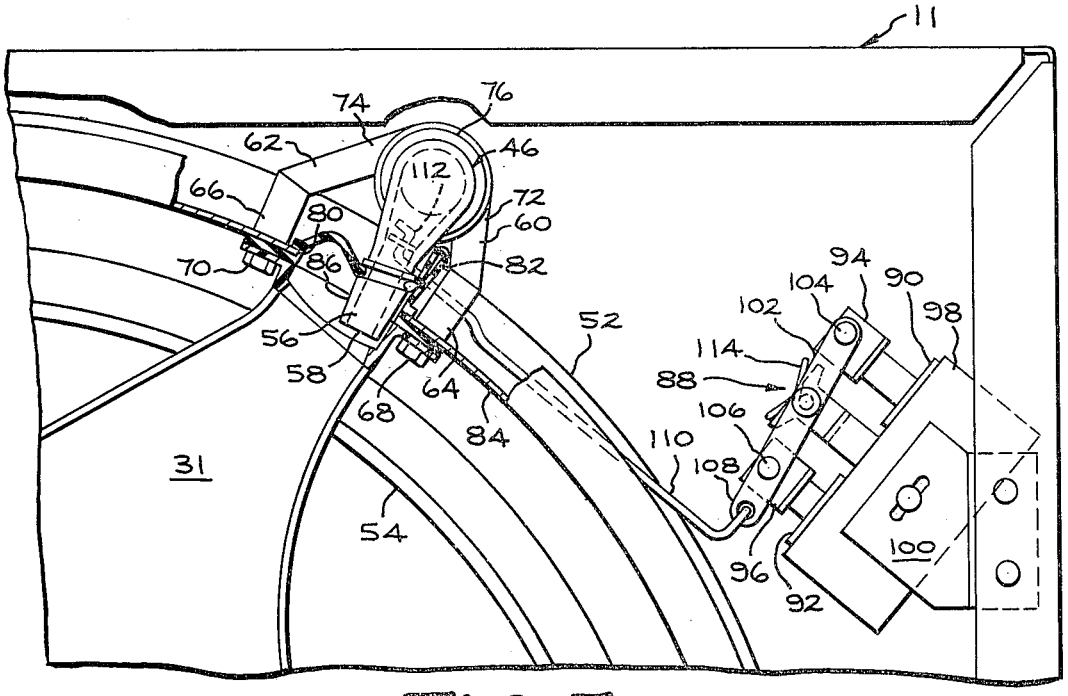
FIG. 3 is a fragmentary enlarged sectional view of the improved liquid diverter in the third position.

With this arrangement then, to obtain one position of the nozzle 56 the solenoids 90 and 92 are both de-energized and the centering of lever arm 102 is caused by the biasing means 114 and is the position as shown in FIG. 1. Another nozzle position is obtained by energization of solenoid 90 to overcome the biasing means 114 resulting in the rod 110 being pushed in the direction of the nozzle 56 thus moving the nozzle to the position shown in FIG. 2. The third position of the nozzle 56 is obtained by energization of solenoid 92 so that the plunger 96 is moved inwardly to the position shown in FIG. 3 and correspondingly pulls the end of lever arm 108 with it and also rod 110 and nozzle 56.

The energization of the respective solenoids 90 and 92 independently and the de-energization of both those solenoids is accomplished by the machine controls so that the nozzle 56 is selectively moved to one of three positions at the proper time during the cycle operation of the machine so that the proper compartments of the dispenser 10 may be flushed as previously described.

The foregoing is a description of the preferred embodiment of the invention and variations may be made thereto without departing from the true spirit of the invention, as defined in the appended claims.

What is claimed is:

1. In an automatic washer having a basket, an outer tube and an additive dispensing system including a multi-compartmented dispenser, a liquid flow diversion arrangement having a liquid diverter mechanism for selectively diverting liquid into pre-selected dispenser compartments for flushing the additives into the tub at pre-determined times during a cylce of the washer, the improvement comprising:

a. a pivotal body with a liquid inlet opening at one end connected to a water inlet means and a nozzle at the other end with a liquid outlet opening in liquid flow communication with the dispenser, and b. a three position nozzle control mechanism including two solenoids with plungers, a lever arm connecting the solenoid plungers, biasing means to center the lever arm when both solenoids are de-energized, and a rod connecting the lever arm and the nozzle whereby the nozzle is pivoted to a different position responsive to separate energization fo each solenoid and de-energization of both solenoids.

2. In the automatic washer of claim 1 wherein the nozzle of the pivotal body is through the side wall of the tub and a flexible diaphragm is utilized as a liquid seal between the tub and the nozzle.

3. In the automatic washer of claim 1 wherein the water inlet means supplying water to the liquid inlet opening of the pivotal body is a pumping means recirculating water from the tub to the basket.

4. In the automatic washer of claim 1 wherein the pivotal body is L-shaped and the inlet opening and the nozzle outlet opening are at right angles to each other.

5. In the automatic washer of claim 4 wherein the L-shaped body has a shoulder that cooperates with a cylindrical member secured to the tub for support of the L-shaped body.

* * * * *

UNITED STATES PATENT AND TRADEMARK OFFICE

CERTIFICATE OF CORRECTION

PATENT NO. : 4,111,011
DATED : September 5, 1978
INVENTOR(S) : Waugh

It is certified that error appears in the above-identified patent and that said Letters Patent are hereby corrected as shown below:

Column 5, Line 2, Claim 1, the word "tube" should be "tub".

Column 6, Line 2, Claim 1, the word "fo" should be "of".

Signed and Sealed this

*Third* Day of *April 1979*

[SEAL]

*Attest:*

RUTH C. MASON
*Attesting Officer*

DONALD W. BANNER
*Commissioner of Patents and Trademarks*